US006848239B2

(12) United States Patent
Shibazaki et al.

(10) Patent No.: US 6,848,239 B2
(45) Date of Patent: Feb. 1, 2005

(54) BAND REFEEDING METHOD IN BANDING PACKING MACHINE AND BANDING PACKING MACHINE HAVING REFEEDING MECHANISM

(75) Inventors: Tokio Shibazaki, Kawasaki (JP); Kenichi Enda, Kawasaki (JP); Yoshikatsu Aizawa, Kawasaki (JP); Saburo Tsurumaki, Chiba (JP); Mitsuru Sato, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 10/677,021

(22) Filed: Oct. 1, 2003

(65) Prior Publication Data

US 2004/0060259 A1 Apr. 1, 2004

(30) Foreign Application Priority Data

Oct. 1, 2002 (JP) ..... 2002-288808

(51) Int. Cl.[7] ..... B65B 13/02

(52) U.S. Cl. ..... 53/399; 53/588; 53/589; 53/389.1

(58) Field of Search ..... 53/399, 588, 589, 53/389.1; 242/554, 563.2, 563

(56) References Cited

U.S. PATENT DOCUMENTS

| | | | | |
|---|---|---|---|---|
| 3,946,921 A | | 3/1976 | Noguchi | |
| 4,691,498 A | | 9/1987 | Stamm | |
| 4,955,180 A | * | 9/1990 | Sakaki et al. | 53/399 |
| 5,079,899 A | * | 1/1992 | Kurachi | 53/399 |
| 5,083,412 A | * | 1/1992 | Sakaki et al. | 53/399 |
| 5,560,187 A | | 10/1996 | Nagashima et al. | |
| 5,651,306 A | | 7/1997 | Hoshino | |
| 6,038,967 A | | 3/2000 | Chak et al. | |
| 6,363,689 B1 | * | 4/2002 | Rodriguez et al. | 53/399 |
| 6,655,117 B2 | * | 12/2003 | Hoshino | 53/589 |

FOREIGN PATENT DOCUMENTS

| | | |
|---|---|---|
| DE | 37 34 663 A | 4/1988 |
| EP | 0 353 505 A1 | 2/1990 |
| EP | 0 596 288 A2 | 5/1994 |
| EP | 0 604 783 A2 | 7/1994 |
| EP | 1 174 376 A2 | 1/2002 |
| EP | 1 298 059 A | 4/2003 |
| GB | 2 019 040 A | 10/1979 |
| JP | 2000-289706 A | 10/2000 |

OTHER PUBLICATIONS

Patent Abstracts of Japan, vol. 013, No. 526 (M–897), JP 01–213107, published Aug. 25, 1989, Nichiro Kogyo KK, "Automatic Band Loading Method in Arch Type Automatic Packing Machine".

* cited by examiner

*Primary Examiner*—Eugene Kim
(74) *Attorney, Agent, or Firm*—Webb Ziesenheim Logsdon Orkin & Hanson, P.C.

(57) ABSTRACT

A band refeeding method in a banding packing machine is disclosed which can prevent the tip portion of a band from being excessively pulled back even if the band is not supplied correctly but is automatically pulled back, and can stay the band in a predetermined position and can successively supply the band to the band guide arch side. A length of a band to be pulled back to an original position by band pull back means is previously detected based on the number of rotations of a touch roller constituting band supply means. In addition, the number of rotations of the touch roller before reaching a predetected set value is detected when the tip portion of the band is pulled back. Then, a rotating speed of a roller of the band pull back means is reduced when the number of rotations is detected. Therefore, the roller of the band pull back means is subsequently rotated at the low speed, thereby pulling back the tip of the band to a predetermined position.

2 Claims, 6 Drawing Sheets

PRIOR ART

PRIOR ART

BAND REFEEDING METHOD IN BANDING PACKING MACHINE AND BANDING PACKING MACHINE HAVING REFEEDING MECHANISM

BACKGROUND OF THE INVENTION

1. Field of the Invention

The present invention relates to a band refeeding method in a banding packing machine and the banding packing machine having a refeeding mechanism. More particularly, this invention relates to a band refeeding method in a banding packing machine and the banding packing machine having a refeeding mechanism in which a band is fed to a predetermined position on the band guide arch side and in this state, when the band does not reach the predetermined position, the band is once returned and is then fed again and supplied to the predetermined position.

2. Description of the Related Art

As shown in FIGS. 5 and 6, for example, in a full automatic type banding packing machine 20, a band guide arch 22 for guiding a band like a loop around an article 36 to be packed is provided above a packing machine body 21. Moreover, a band reel 25 having a large amount of band B wound therearound is provided on the side surface of the packing machine body 21.

On the other hand, a pool box 24 is formed by partition under the front surface of the packing machine body 21.

Moreover, as shown in FIG. 6, a control portion 28 provided on the upper part of the packing machine body 21 includes band supply means 30 having a pair of rollers for supplying the band B toward the band guide arch 22 side, band pull back means 31 having a pair of rollers for pulling back the band from the band guide arch 22 side conversely, and band tightening means 32 for further tightening the band thus pulled back. The band supply means 30 is constituted by a normal rotating roller 30*a* for normal rotating and a touch roller 30*b* to come in pressure contact therewith. Furthermore, the band pull back means 31 and the band tightening means 32 are constituted by a reverse rotating roller 32*a* and a touch roller 30*b* to come in pressure contact therewith.

The touch roller 30*b* is operated by a link 40, thereby coming in pressure contact with the normal rotating roller 30*a* or the reverse rotating roller 32*a*. In FIG. 6, for convenience, the touch roller 30*b* is shown in an abutting state on the reverse rotating roller 32*a*.

Furthermore, in the control portion 28, the tip portion of the band B, which surrounds the article 36 to be packed, is interposed between the tip portion of a right presser member 42 capable of vertically moving and a slide table 37 below the band guide arch 22. Then, a band guide 34 supported to freely appear by a shaft is moved backward from below the slide table 37 in the interposition state between the right presser member 42 and the slide table 37. Thereafter, the band B is pulled back toward the pool box 24 side by the band pull back means 31 and is further tightened by the band tightening means 32. Furthermore, a left presser member 39 is moved upward to maintain the band B to be tightened between the left presser member 39 and the slide table 37. Then, a middle presser member 41 is moved upward to lift the band B, thereby cutting the rear end side of the band B by means of a cutter 41*a*. A heater is inserted to freely appear in a horizontal direction in the superposing portion of the band, thereby melting the surface of the superposing portion of the band. Furthermore, the middle presser member 41 is successively lifted to bond the superposing portion of the band between the middle presser member 41 and the slide table 37.

The reference numeral 43 in FIG. 6 denotes a stopper provided in the band guide 34. When the tip portion of the band reaches the stopper 43 and a limit switch is turned ON, the band is subsequently pulled back by the band pull back means 31 based on a signal. Furthermore, the band is tightened by the band tightening means 32 and the cutting and welding operations of the band are further carried out in order in a predetermined timing while they are controlled by a cam mechanism (not shown) for controlling the vertical movement of the right presser member 42, the left presser member 39, the middle presser member 41 and the like. The cam mechanism for controlling the vertical movement of the right presser member 42, the left presser member 39 and the middle presser member 41 is constituted between respective cam followers attached to the lower parts of the right presser member 42, the left presser member 39 and the middle presser member 41 and a cam shaft (not shown) provided with cams corresponding to the cam followers (see FIG. 4).

In the conventional banding machine 20, the band B is supplied toward the band guide arch 22 side by the band supply means 30. If the tip portion of the band B is twisted, it cannot reach the stopper 43 but is stopped in the middle of the band guide arch 22, for example.

In such a case, that is, in the case in which the tip of the band B does not reach the stopper 43 of the band guide 34 even if a predetermined time passes, the band pull back means 31 is automatically operated to once pull back the tip portion of the band B from the band guide arch 22 and to supply the band by the band supply means 30 again. As a result, the band is fed toward the band guide arch 22 side again.

However, in the conventional banding packing machine 20, in some cases in which the band B is further pulled back by the band pull back means 31 side, the tip portion of the band B vigorously passes not only through the band pull back means 31, but also through the normal rotating roller 30*a* of the band supply means 30. If the tip portion of the band B pulled back thus gets over the peripheral surface of the normal rotating roller 30*a*, the band cannot be supplied by the band supply means 30 again. As a result, an operator must search for the tip portion of the band from the inner part of the packing machine body, and guide the tip portion of the band to a correct position passing through a portion between the normal rotating roller 30*a* and the touch roller 30*b*.

SUMMARY OF THE INVENTION

The present invention overcomes the above problem by providing a band refeeding method in a banding packing machine in which the tip portion of a band can be prevented from being pulled back excessively beyond a predetermined position even if the band is automatically pulled back, and the band can be successively supplied toward the band guide arch side by means of a normal rotating roller.

Moreover, the present invention provides a banding packing machine capable of easily executing the band refeeding mechanism.

Briefly stated, the present invention provides a band refeeding method in a banding packing machine, in which, when the tip of the band to be supplied to a predetermined position of a band guide arch by the band supply means is stopped in such a state that it does not reach the predetermined position, band pull back means having a pair of rollers is driven in place of band supply means having a pair of rollers and a tip portion of a band is returned to an original band feeding position by the band pull back means, and then the band supply means is driven again, whereby the tip portion of the band is supplied to the predetermined position on the band guide arch side, comprising the steps of:

previously detecting a correct length of the band to be pulled back to the original band feeding position by the band pull back means based on the number of rotations which is obtained from a start of the supply of the band by a touch roller constituting the band supply means to a stop thereof; and detecting the number of rotations of the touch roller corresponding to a smaller length than the amount of pulling back having the correct length detected previously, when the tip portion of the band is pulled back from such a position that it is stopped, reducing a rotating speed of the roller of the band pull back means when the number of rotations is detected, and subsequently rotating the roller of the band pull back means at the low speed, whereby the tip of the band is pulled back to a set position.

According to the present invention having such a structure, in the case in which the band causes a defective normal rotation and is once pulled back, it can be pulled back at a pulling back speed in two stages, that is, which is high at first and is then low. Accordingly, the band can be prevented from being vigorously pulled back excessively as usual.

Consequently, the band pulled back can be fed toward the band guide arch side again by the band supply means.

Moreover, the present invention provides a banding packing machine having a refeeding mechanism comprising:

a band guide arch;

band supply means having a pair of rollers; and band pull back means having a pair of rollers, in which a tip portion of a band is supplied to the band guide arch side by the band supply means, and the band pull back means is driven in place of the band supply means, when the tip of the band is stopped in such a state that it does not reach a predetermined position, and the tip portion of the band is returned to an original band feeding position by the band pull back means and the band supply means is then driven again to supply the tip of the band to the predetermined position on the band guide arch side, wherein a correct length of the band to be pulled back to the original band feeding position by the band pull back means is previously detected based on the number of rotations, which is obtained from a start of the supply of the band by a touch roller constituting the band supply means to a stop thereof; and the number of rotations of the touch roller corresponding to a smaller length than the amount of pulling back having the correct length detected previously is detected when the tip portion of the band is pulled back from such a position that it is stopped, a rotating speed of the roller of the band pull back means is reduced when the number of rotations is detected, and the roller of the band pull back means is subsequently rotated at the low speed, whereby the tip of the band is pulled back to a set position.

According to the banding packing machine having such a structure, the band can reliably be refed.

DETAILED DESCRIPTION OF THE INVENTION

An embodiment of the present invention will be described below with reference to the drawings.

Figure 1:
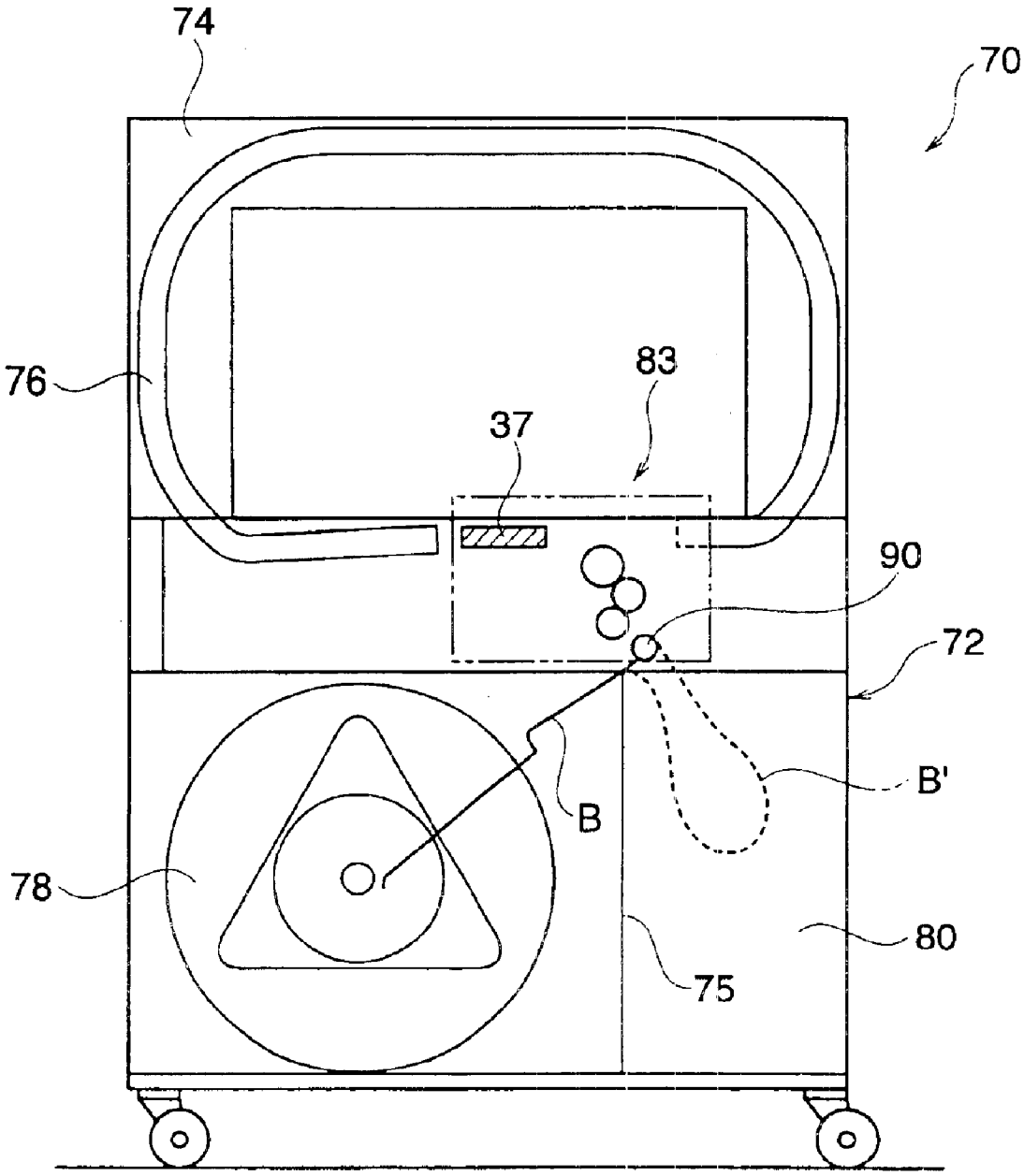
FIG. 1 is a schematic view showing a banding packing machine according to an embodiment of the present invention.

FIG. 1 shows an automatic banding packing machine having a band refeeding mechanism according to the embodiment of the present invention.

In an automatic banding packing machine 70, an almost U-shaped band guide arch 74 is provided above a packing machine body 72. In the band guide arch 74, a serial band passage 76 drawing a loop is formed over the packing machine body 72.

On the other hand, a band reel 78 is accommodated to be freely taken in/out in the left half part of the packing machine body 72 in FIG. 1.

A back pool box 80 is formed by a partition plate 75 in the right half part of the packing machine body 72.

The back pool box 80 serves to temporarily store a band B pulled back from the band guide arch 74 when one banding is to be carried out. A control portion 83 for supplying and pulling back the band is constituted between the back pool box 80 and a slide table 37 provided in the upper part of the packing machine body 72.

Figure 2:
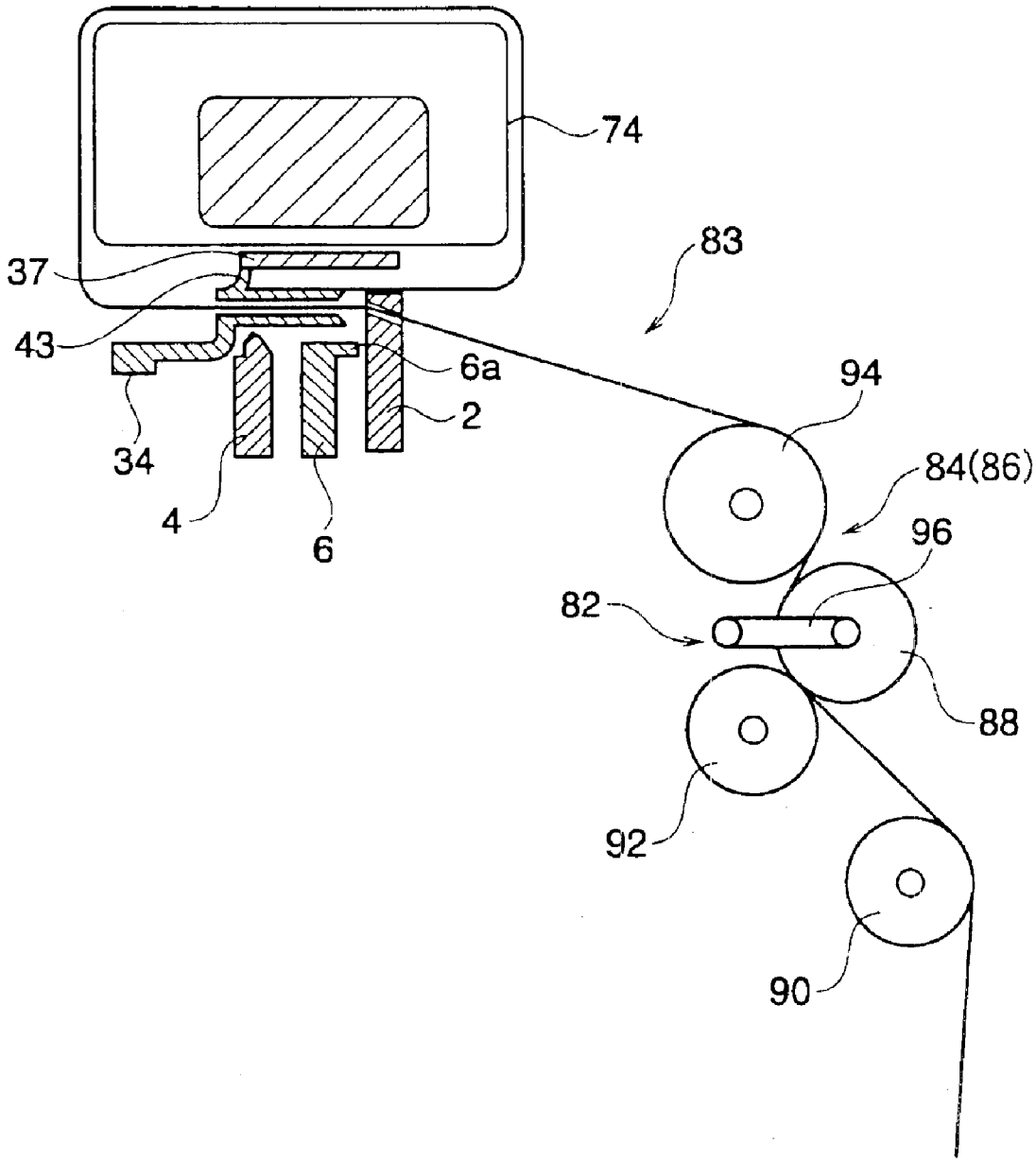
FIG. 2 is a schematic view showing a control portion employed in the embodiment.
Figure 5:
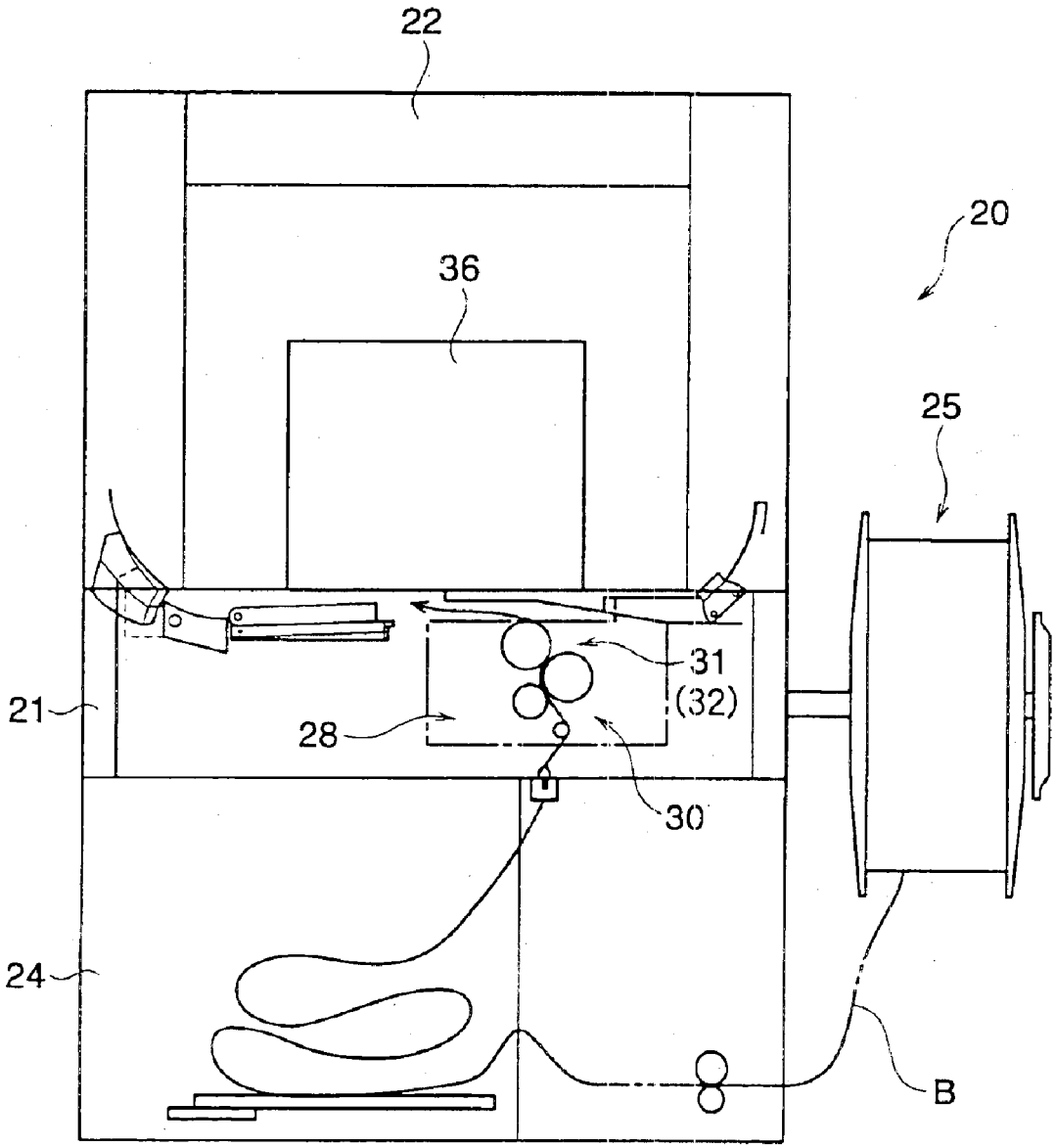
FIG. 5 is a schematic view showing a conventional automatic banding packing machine.
Figure 6:
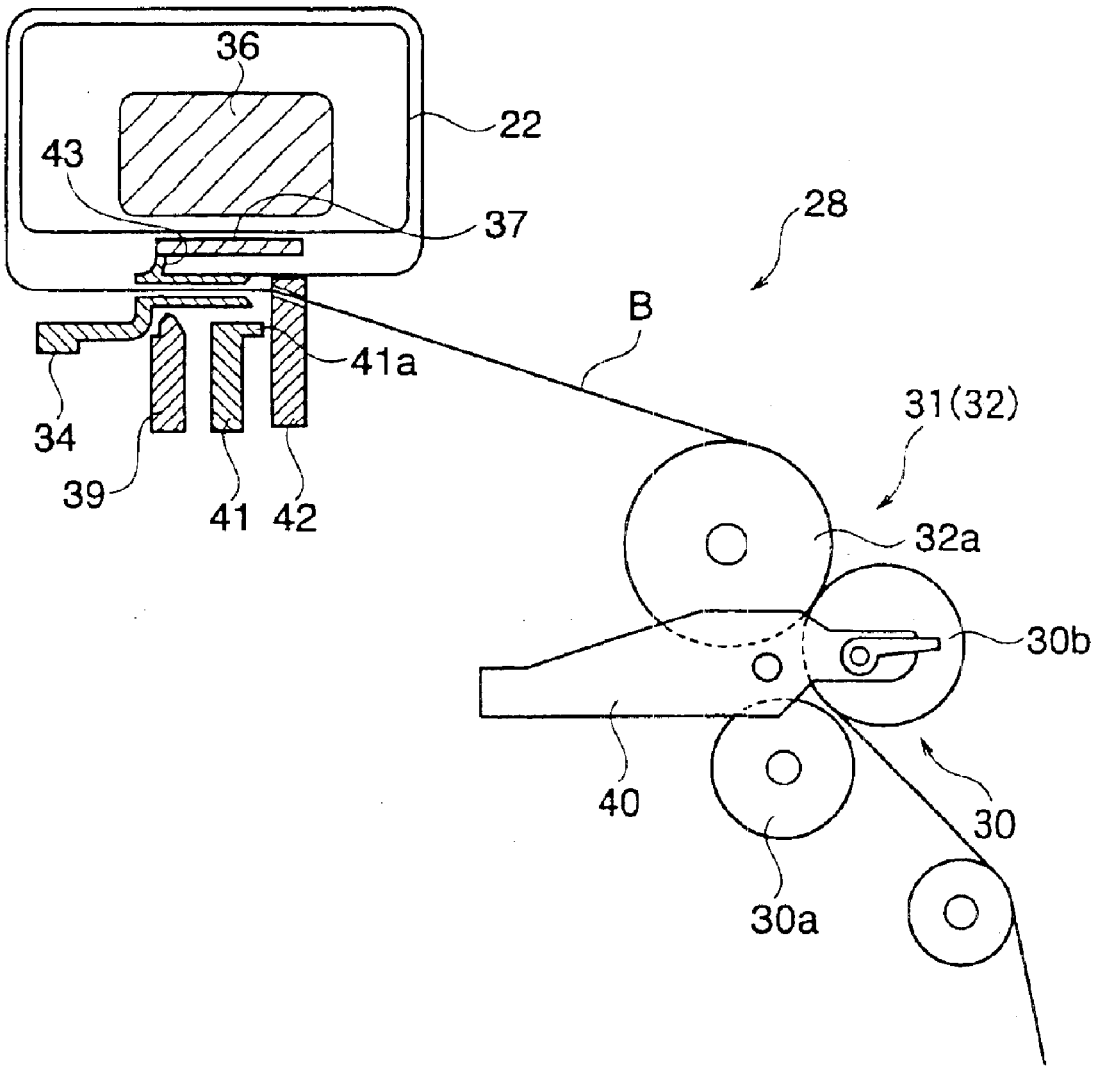
FIG. 6 is a schematic view showing a control portion of the conventional banding packing machine.

As shown in FIG. 2, the control portion 83 includes a guide roller 90, band supply means 82 for supplying a band toward the band guide arch 74 side, band pull back means 84 for pulling back the band from the band guide arch 74 side toward the back pool box 80 side, and band tightening means 86 for further strongly tightening the band pulled back by the band pull back means 84. Furthermore, control portion 83 includes a right presser member 2 for holding the rear end side of the band so as not to slip off, a left presser member 4 for being lifted to press the band when tightening the band, a middle presser member 6 for cutting the band B by means of a cutter 6*a* and upward pressing the band B molten by heat, and the like. These structures are almost the same as the conventional structures shown in FIGS. 5 and 6.

More specifically, the band pull backmeans 84 also serves as the band tightening means. 86, and is constituted by a pair of rollers including a reverse rotating roller 94 and a touch roller 88. Moreover, the touch roller 88 is supported by a link 96 or the like. When the link 96 is operated by driving means which is not shown, the touch roller 88 can be caused to come in contact with a normal rotating roller 92 or the reverse rotating roller 94 by pressure.

In the case in which the touch roller 88 is caused to come in contact with the normal rotating roller 92 by pressure as shown in FIG. 2, the touch roller 88 separates from the reverse rotating roller 94. To the contrary, when the touch roller 88 is caused to come in contact with the reverse rotating roller 94 by-pressure, it separates from the normal rotating roller 92.

On the other hand, if the touch roller 88 is caused to come in contact with the reverse rotating roller 94 by pressure, the band can be pulled back and tightened.

Figure 3:
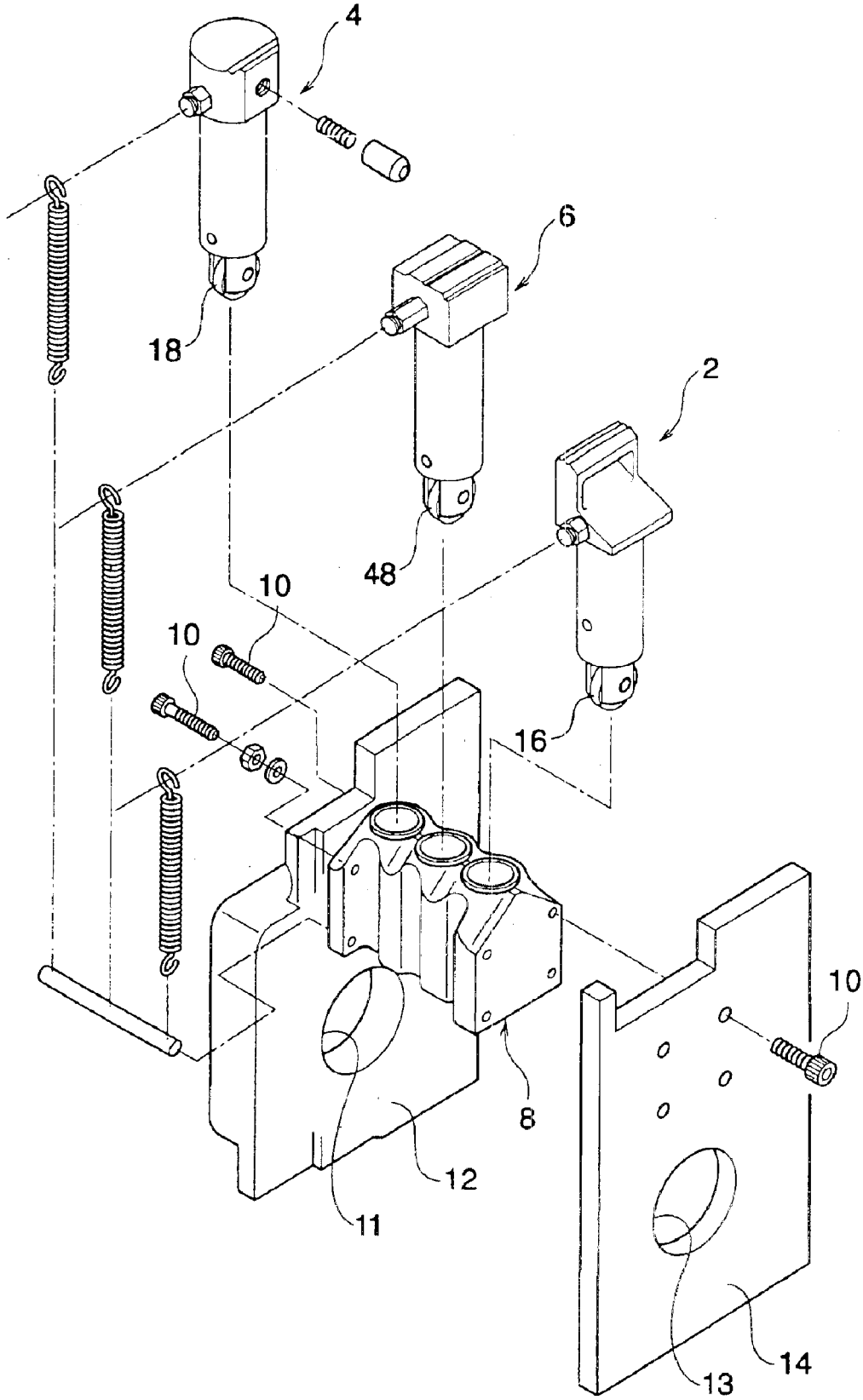
FIG. 3 is an exploded perspective view showing a right presser member, a left presser member and a middle presser member which serve to hold, return, cut and weld a band in the embodiment.

FIG. 3 shows the assembly structure of a right presser member 2, a left presser member 4 and a middle presser member 6 which serve to carry out operations for clamping, welding and cutting the tip portion of the band by the action of a cam. These three members are arranged straight in a horizontal direction below the slide table 37 provided in the upper part of the packing machine body 72.

More specifically, the right presser member 2, the left presser member 4 and the middle presser member 6 are accommodated in a support block 8. The support block 8 is supported between a pair of surface plates 12 and 14 with a screw member 10 or the like.

Figure 4:
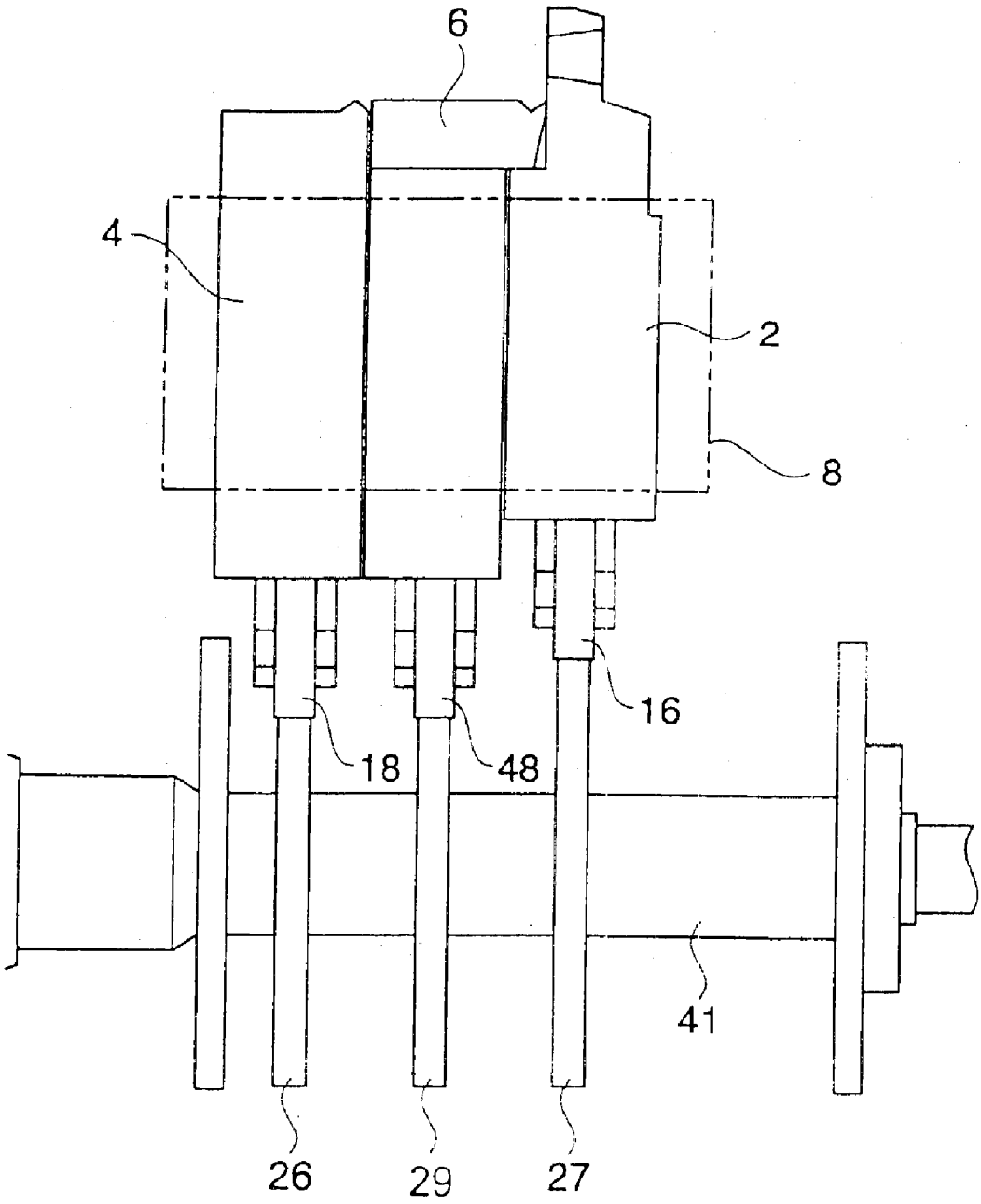
FIG. 4 is a front view showing a state in which the right presser member, the left presser member and the middle presser member illustrated in FIG. 3 are assembled.

On the other hand, a cam shaft 41 is rotatably supported in shaft insertion holes 11 and 13 formed on the surface plates 12 and 14 as shown in FIG. 4. The cam shaft 41 is rotated upon receipt of the force of a driving source such as a motor which is not shown. Cam followers 16, 18 and 48 are attached to the lower parts of the right presser member 2, the left presser member 4 and the middle presser member 6, respectively. These cam followers 16, 18 and 48, respectively, abut on the peripheral surfaces of cams 27, 26 and 29 provided on the cam shaft 41.

In the automatic banding packing machine according to the present embodiment, the tip portion of the band is supplied to the band guide arch 74 by the band supply means 82 and is wound circumferentially like a loop around the band guide arch 74. Then, the tip portion of the band abuts on a stopper 43 of a band guide 34 to turn ON a limit switch. In this state, banding is started.

Even if a predetermined time passes after the band is supplied by the band supply means 82, however, it is decided that a defective normal rotation is caused when the limit switch is not turned ON. Consequently, the band supply means 82 is stopped. Instead, the band pull back means 84 is driven. After the band B is pulled back toward the band supply means 82 side by the band pull back means 84, the band is supplied toward the band guide arch 74 side by the band supply means 82 again.

In order to pull back the band toward the band supply means 82 side by the band pull back means 84 in the present embodiment, the band is pulled back at a speed in two stages so as not to be excessively pulled back.

For this reason, the amount of supply of the band in the banding packing machine is previously detected in the present embodiment. More specifically, the amount of supply of the band is a length obtained from the start of the supply of the band to the arrival of the tip of the band at the stopper 43. The length can be converted into the number of rotations of the touch roller 88 constituting the band supply means 82.

More specifically, a length obtained until the tip of the band is fed toward the band guide arch 74 side and then reaches the stopper 43 can be converted into the number of rotations of the touch roller 88 after the start of the supply of the band.

On the other hand, it is preferable to detect the number of rotations of the touch roller 88 in a reverse direction in a state in which the tip of the band reaches the stopper 43 in order to obtain the length of pulling back of the band. An actual length of pulling back of the band is determined by the sizes of the band guide arch 74 and an article to be packed.

In the present embodiment, the length of feed of the band is measured at each time and the length of pulling back of the band corresponding to the length is calculated. A correct length of the band to be pulled back is represented by $\alpha$. In the case in which the correct length of the band to be pulled back is represented by $\alpha$ in the present embodiment, the pulling back speed of the band is reduced when the band is pulled back to have a smaller length $\beta$. Whether the length of pulling back of the band reaches the length $\beta$ is preferably obtained by measuring the number of rotations of the touch roller 88 in a reverse direction. It is sufficient that the number of rotations is converted into the length of the band. When the length of the band pulled back reaches the length $\beta$, the pulling back speed of the band is reduced to pull back the band again.

In the present embodiment, thus, the band is pulled back at the speed in two stages. Consequently, it is possible to prevent the tip of the band from being pulled back beyond the normal rotating roller 92 when the band is to be pulled back and supplied again, for example. Accordingly, it is not necessary to carry out such a complicated work that an operator searches for the tip portion of the band and carries out a reset in a correct position.

In addition, the band is pulled back at a low speed for a last part. Therefore, a time taken for this work can also be reduced.

In the case in which such band refeeding is to be carried out, moreover, any component is not required specially but a conventional structure is enough. Therefore, a cost can also be reduced.

While the embodiment of the present invention has been described above, the present invention is not restricted thereto.

While one touch roller 88 is used for the three means including the band supply means 82, the band pull back means 84 and the band tightening means 86 in the above embodiment, for example, these three means can also be provided separately.

Moreover, the present invention is effective for the case in which a distance between the two driving rollers including the reverse rotating roller 94 on the reverse rotating side and the normal rotating roller 92 on the normal rotating side is very small. Furthermore, the present invention can be applied to the case in which the distance between these two rollers is very great.

Furthermore, both the amount of supply of the band and the amount of pulling back of the band are detected based on the number of rotations of the touch roller. Therefore, the amount of pulling back of the band can be determined corresponding to the amount of the band supplied into the arch. Consequently, an error is lessened.

As described above, in the band refeeding method in the automatic banding packing machine according to the present invention, the pulling back speed of a band is set into two stages. Even if the band is automatically pulled back from the band guide arch side, consequently, the tip portion of the band can be prevented from being excessively pulled back.

In the case in which the band is pulled back from the inside of the band guide arch, moreover, the operation is just the same as an existing operation except that the rotating speed of the band pulling back roller is set into two stages, that is, to be high at first and to be then low. Consequently, a separate member is not required specially. Accordingly, it is possible to inexpensively form a structure without increasing a size.

According to the banding machine having the band refeeding mechanism in accordance with the present invention, moreover, the tip portion of the band can be prevented from being pulled back excessively. Consequently, the refeeding can reliably be executed.

What is claimed is:

1. A band refeeding method in a banding packing machine in which, when the tip of the band to be supplied to a predetermined position of a band guide arch by the band supply means is stopped in such a state that it does not reach the predetermined position, band pull back means having a pair of rollers is driven in place of band supply means having a pair of rollers and a tip portion of a band is returned to an original band feeding position by the band pull back means, and then the band supply means is driven again, whereby the tip portion of the band is supplied to the predetermined position on the band guide arch side, comprising the steps of:

previously detecting a correct length of the band to be pulled back to the original band feeding position by the band pull back means based on the number of rotations which is obtained from a start of the supply of the band by a touch roller constituting the band supply means to a stop thereof; and detecting the number of rotations of the touch roller corresponding to a smaller length than the amount of pulling back having the correct length detected previously, when the tip portion of the band is pulled back from such a position that it is stopped, reducing a rotating speed of the roller of the band pull back means when the number of rotations is detected, and subsequently rotating the roller of the band pull back means at the low speed, whereby the tip of the band is pulled back to a set position.

2. A banding packing machine having a refeeding mechanism comprising:

a band guide arch;

band supply means having a pair of rollers; and band pull back means having a pair of rollers, in which a tip portion of a band is supplied to the band guide arch side by the band supply means, and the band pull back means is driven in place of the band supply means, when the tip of the band is stopped in such a state that it does not reach a predetermined position, and the tip portion of the band is returned to an original band feeding position by the band pull back means and the band supply means is then driven again to supply the tip of the band to the predetermined position on the band guide arch side, wherein a correct length of the band to be pulled back to the original band feeding position by the band pull back means is previously detected based on the number of rotations, which is obtained from a start of the supply of the band by a touch roller constituting the band supply means to a stop thereof; and the number of rotations of the touch roller corresponding to a smaller length than the amount of pulling back having the correct length detected previously is detected when the tip portion of the band is pulled back from such a position that it is stopped, a rotating speed of the roller of the band pull back means is reduced when the number of rotations is detected, and the roller of the band pull back means is subsequently rotated at the low speed, whereby the tip of the band is pulled back to a set position.

* * * * *